US005560384A

United States Patent [19]

Oh

[11] Patent Number: 5,560,384

[45] Date of Patent: Oct. 1, 1996

[54] RECYCLABLE TARPAULIN SHEET

[75] Inventor: Sei-Yoon Oh, Seoul, Rep. of Korea

[73] Assignee: Korea Tarpaulin Inc., Seoul, Rep. of Korea

[21] Appl. No.: 242,819

[22] Filed: May 16, 1994

[30] Foreign Application Priority Data

Feb. 3, 1994 [KR] Rep. of Korea ..... 1994/2021

[51] Int. Cl.[6] ..... E04H 15/54

[52] U.S. Cl. ..... 135/115; 135/119; 2/274; 2/69.5

[58] Field of Search ..... 135/87, 90, 105, 135/106, 115, 119; 2/274, 275, 255, 89, 69.5

[56] References Cited

U.S. PATENT DOCUMENTS

| | | | |
|---|---|---|---|
| 914,708 | 3/1909 | Duval | 135/87 X |
| 3,590,864 | 7/1971 | Vechesloff | 135/87 X |
| 3,766,566 | 10/1973 | Tadokoro | 2/275 |
| 4,367,761 | 1/1983 | Winant | 135/87 |
| 4,372,998 | 2/1983 | Shimada | 2/274 |
| 4,537,210 | 8/1985 | Montgomery | 135/87 |
| 4,642,868 | 2/1987 | Pandell | 135/115 X |
| 4,958,652 | 9/1990 | Maya | 135/87 |
| 4,966,181 | 10/1990 | Liberman et al. | 135/87 |

FOREIGN PATENT DOCUMENTS

| | | | |
|---|---|---|---|
| 1483148 | 6/1967 | France | 135/87 |
| 9104382 | 4/1991 | WIPO | 135/87 |

*Primary Examiner*—Lanna Mai

*Attorney, Agent, or Firm*—Lowe, Price, LeBlanc & Becker

[57] ABSTRACT

An outdoor sunscreen formed without rope or pole connecting eyelets includes a fabric sheet having a reinforced margin. The reinforced margin is a two-layered structure and lengthwise receives a reinforcing band therein. This margin is formed by folding an edge of the sheet with the reinforcing band lengthwise placed in the folded edge and by fusion welding together inner surfaces of the folded edge through high frequency heating. A plurality of arcuate punched slits are formed on the reinforced margin for providing a rope reception hole. In the fabric sheet, wefts and warps of the reinforced margin are tightly woven such that a woven structure of the margin about each punched slit endures a tensile force applied thereto from a tightened rope.

7 Claims, 2 Drawing Sheets

RECYCLABLE TARPAULIN SHEET

BACKGROUND OF THE INVENTION

1. Field of the Invention

The present invention relates in general to outdoor goods and, more particularly, to outdoor sunscreens for screening people and goods from the sun and providing the shade in the open air.

2. Description of the Prior Art

In a picnic at a sunny location glaring sunlight should be screened to protect excursionists from the sun. To that end, a tent or sunscreen is conventionally used. When it is required to accommodate many people in the shade, the sunscreen is more profitable since it provides a larger shaded area than the conventional tent.

Such a sunscreen may be also used for covering a large amount of goods for preservation of same in the open air. The sunscreen along with the goods covered thereby is tightened by ropes, to maintain the goods for a long time period and achieve desired safety in preservation of the goods.

When pitching the sunscreen in a plurality of ropes are tightened using pegs to erect poles. The ropes cooperate with the poles in order to retain the balance of the sunscreen. The tops of the standing poles are inserted in corresponding holes of the sunscreen.

With reference to FIG. 4, there is shown a corner section of a conventional sunscreen. In order to produce the sunscreen, the edge of a sunscreen sheet 1, (formed of a woven fabric produced by weaving wefts and warps), is folded with a reinforcing band 2 received in a bulging portion of the folded edge. Thereafter, the sheet 1 is sewn at the inside edge and at the outside edge of the folded portion, thus to form a reinforced margin 3. The sheet 1 is in turn punched at the corners and at regularly spaced points along the reinforced margin 3. In order to reinforce the punched holes, all of the punched holes are fitted with eyelets 5 having their openings 4. The fitting of the eyelets 5 in the punched holes is conventionally achieved by rivetting. The eyelets 5 also rivet the folded sheets of the reinforced margin 3 together. As described above, the production process of the conventional sunscreen comprises several steps, that is, edge folding, sewing, punching and eyelet rivetting. The productivity of the sunscreens is thus deteriorated. The location of the eyelets 5 is impossible to be changed since the eyelets 5 are fitted on predetermined points of the sheet 1 by rivetting during the production process of the sunscreen. This often causes the sunscreen to lose its balance when the sunscreen needs pitching on uneven ground.

The folded and sewed portion of the fabric sheet 1 forms the reinforced margin 3, so that the sheet 1, particularly the margin 3 may be damaged or deformed at about the eyelets 5 due to a possible increase of tensile force of the ropes caused by a change of temperature and/or a change of weather. This makes the sunscreen short-lived. With the plurality of eyelets 5 tightly fitted on the sheet 1 by rivetting, the sunscreen having served its time can not be subjected to reproduction unless all the eyelets are removed from the sheet 1 requiring burdensome manual labor.

Partially cutting of the margin 3 about the eyelets 5 and discarding of the cutout parts for reproduction of the sunscreen causes environmental pollution. The sunscreen is conventionally folded several times to be compact when it is carried along with an excursionist. However, when folding the sunscreen several times, the eyelets 5 are apt to be broken by an outside force and this makes the sunscreen short-lived.

That is, long use of the sunscreen causes the reinforced margin 3 of the sheet 1 to be partially damaged proximate the eyelets 5. In this case, the margin 3 should be partially cut off in order to remove the troubled eyelets 5 and, thereafter, the remaining sheet 1 having no eyelet 5 is subjected to new sewing, new punching and new eyelet rivetting for reuse of the remaining sheet 1. However, an environmental pollution is caused by the cutout parts including the troubled eyelets 5. The sunscreen with the eyelets 5 can not be subjected to the reproduction process since a problem is caused by the eyelets 5 in forming of a new sheet after melting of the sunscreen. When folding a conventional sunscreen, particularly a large-sized sunscreen, several time for carrying it, the eyelets 5 are arranged in a line and this undesirably enlarges the volume of the folded sunscreen such that it is very difficult to treat the folded sunscreen. In addition, the eyelets 5 arranged in a line and facing each other when folding the sunscreen may be broken when they are applied with a sudden outside shock. This makes the sunscreen short-lived.

SUMMARY OF THE INVENTION

It is therefore an object of the present invention to provide an outdoor sunscreen in which the aforementioned problems can be overcome and which is produced by a simple process, free changed in its rope tightening positions and free from possible damage caused by increase of tensile force of tightening ropes due to both a change of temperature and a change of weather, thus to be long-lived.

It is another object of the present invention an outdoor sunscreen which can be used as a tent fly and reproduced by a simple reproduction process when it has served its time.

In order to accomplish the above objects, an outdoor sunscreen in accordance with an embodiment of the present invention comprises: a fabric sheet having a reinforced margin; the reinforced margin having a two-layered structure and lengthwise receiving a reinforcing band therein, the margin being formed by folding an edge of the sheet with the reinforcing band lengthwise placed in the folded edge and by fusion welding of inner surfaces of the folded edge together through a high frequency heating; and a plurality of arcuate punched slits provided on the reinforced margin, each the slit providing a rope reception hole.

In the fabric sheet, wefts and warps of the reinforced margin are such tightly woven that a woven structure of the margin about each punched slit endures a tensile force applied thereto from a tightened rope.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Figure 1:
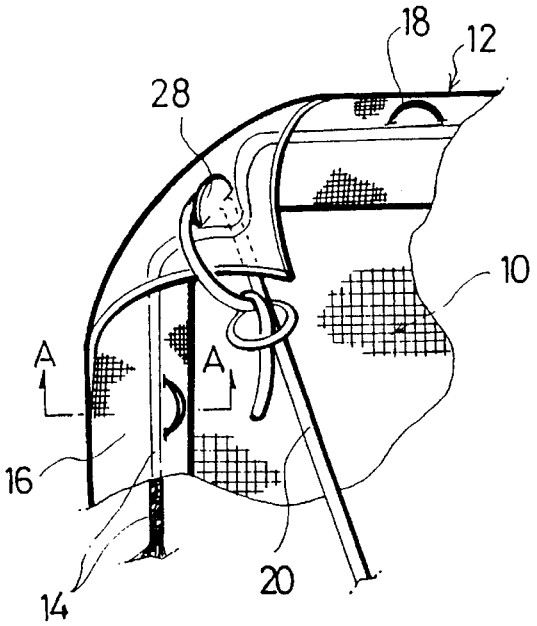
FIG. 1 is a perspective view of a corner section of an outdoor sunscreen in accordance with an embodiment of the present invention.
Figure 2:
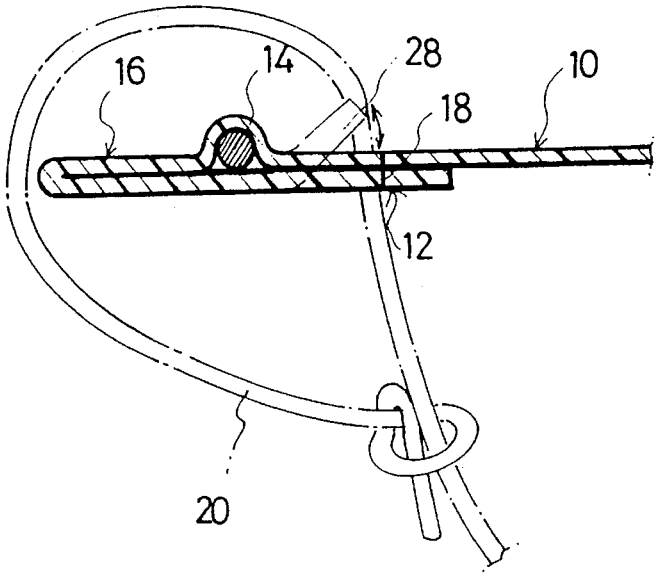
FIG. 2 is a sectional view of a reinforced margin of the corner section taken along the section line A—A of FIG. 1.
Figure 3:
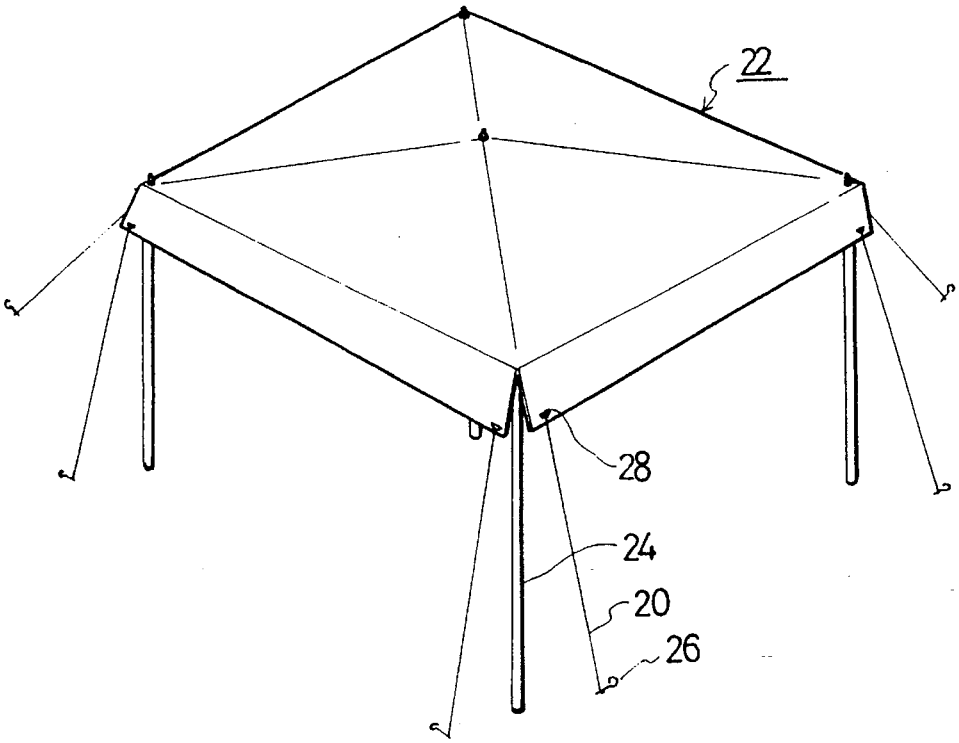
FIG. 3 is a perspective of the sunscreen of the present invention pitched on the ground.

With reference to FIGS. 1 to 3, there is shown an outdoor sunscreen in accordance with an embodiment of the present invention. In order to produce the sunscreen, the edge 12 of a sunscreen sheet 10, which sheet 10 is formed of a woven fabric produced by weaving wefts and warps, is folded upward or downward with a reinforcing band 14 lengthwise received in the folded portion. Thereafter, the folded portion is subjected to high-frequency heating, thus to fusion-weld the inner surfaces of the folded portion to each other and to form a reinforced margin 16 on the folded portion. The reinforced margin 16 has a two layered structure.

The fabric sheet 10 having the reinforced margin 16 is in turn punched using an arcuate punch at the corners and at regularly spaced points along the reinforced margin 16, thereby forming a plurality of arcuate slits 18 for tightening ropes on predetermined points of the reinforced margin 16.

In accordance with the present invention, the edge 12 of the sheet 10 which forms the reinforced margin 16 is more tightly woven than the other section or the inside section of the sheet 10 as represented by the lattices of FIG. 1. The more tight weaving of the wefts and warps into the edge 12 is for achieving a reliable endurance to the tensile force of ropes 20, the tensile force being applied to the arcuate slits 18 when pitching the sunscreen. With the tightly woven margin 16, the opposed ends of the arcuate slits 18 are not torn irrespective of strong tensile forces applied thereto when tightening the ropes 20 for pitching the sunscreen.

In the present invention, the arcuate slits 18 formed on the reinforced margin 16 of the sheet 10 have a symmetrical shape.

In the drawings, the reference numeral 22 denotes the sunscreen, 24 denotes a pole, 26 denotes a peg and 28 denotes a semicircular flap formed by punching of the arcuate slit 18.

As described above, the woven sheet 10 is folded upward or downward at its edge 12 more tightly woven than the inside section of the sheet 10. The reinforced margin 16 is formed by fusion welding of the inner surfaces of the folded edge. This fusion welding is achieved by high-frequency heating. When pitching the sunscreen 22 at a sunny place, the tightening ropes 20 which pass through their slits 18 of the margin 16 prior to knotting about the slits 18 are tightened using pegs 26 so as to be tensioned. At this time, the tensile forces of the ropes 20 are applied to corresponding slits 18. However, the reinforced margin 16 about the slits 18 endures the tensile forces owing to its tightly woven structure and prevents a possible tearing of the opposed ends of the slits 18. The prevention of possible tearing at the opposed ends of the slits 18 is more secured by the presence of the reinforcing band 14 lengthwise received in the margin 16.

The arcuate slits 18 formed on the reinforced margin 16 are preferably spaced out at regular intervals. Each arcuate slit 18 forms the semicircular flap 28 which is opened to define a semicircular hole when inserting the rope 22 into the slit 18. Hence, the insertion of the rope 22 into the slit 18 and the knotting of the rope 22 about the slit 18 are easily achieved.

When removing the rope 22 from the slit 18, the semicircular flap 28 is closed so as to give the sunscreen 22 the appearance of having no holes.

When pitching the sunscreen 22 with the ropes 20 extending from their slits 18, the ropes 20 are tightened using the pegs 26 while standing up the poles 24 whose tops are inserted in corresponding holes formed on corners of the sunscreen 22 as shown in FIG. 3. The pitched sunscreen 22 provides the shade for the excursionists and protects the excursionists from the sun.

The sunscreen 22, whose reinforced margin 16 with the slits 18 is deformed or torn, is reused after simply cutting off the old margin 16, forming a new margin at the edge of the remaining sheet 10 and punching the new margin to form new arcuate slits on the margin. Of course, the new sunscreen obtained from the old sunscreen will be sized smaller than the old sunscreen.

Figure 4:
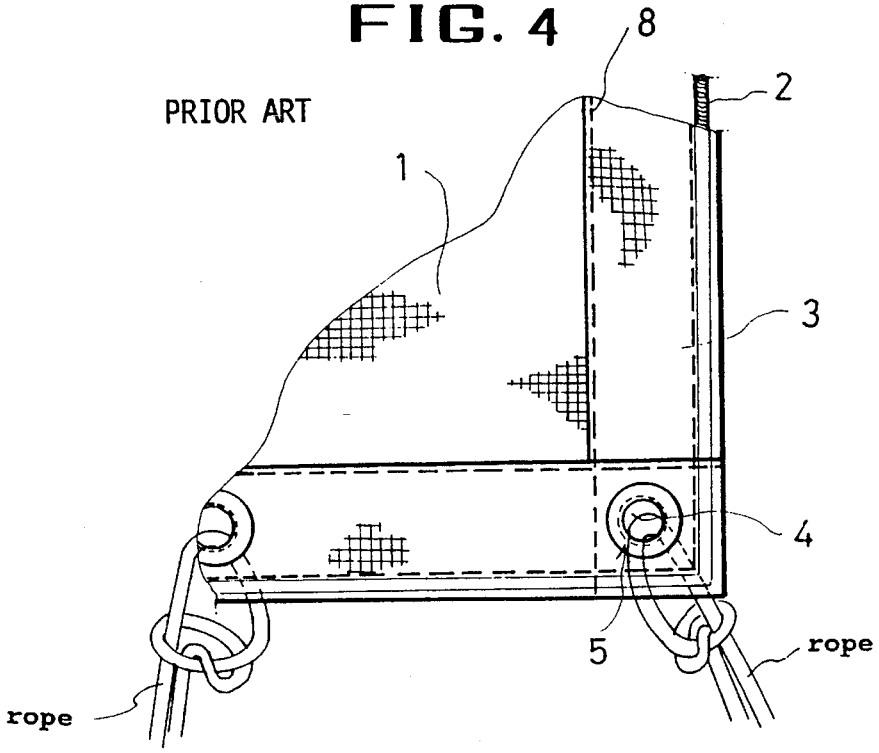
FIG. 4 is a view of a corner section of a conventional sunscreen having eyelets.

Since the sunscreen 22 of this invention has no eyelets 5 unlike the conventional sunscreen of FIG. 4, the sunscreen 22, which has served its time and needs reproducing, simply melts without additional burdensome manual labor to remove the eyelets 5. Hence, this sunscreen 22 not only causes no environmental pollution caused by cutout parts but also simplifies its reproduction process.

The arcuate slits 18 are simply formed by punching the margin 16, i.e., without eyelets 5, so that the volume of the folded sunscreen 22 is reduced and this facilitates treatment of the sunscreen 22, particularly a large-sized sunscreen, when carrying the sunscreen. Since there is no eyelet 5 in the sunscreen 22, the sunscreen 22 is free from problems caused by the eyelets 5, for improved longevity.

The sunscreen 22 of this invention can be used as a sunshade and as a tent fly.

When the sunscreen 22 needs pitching on an uneven ground which may cause loss of balance of the pitched sunscreen, at least one additional slit 18 an additional rope 20 may be formed on the margin 16 using appropriate means, thus to keep the desired balance of the sunscreen 22. At this time, since the margin 16 has the tightly woven structure, the additional slit 18 is prevented from more tearing irrespective of tensile force applied thereto from a corresponding rope 24.

As described above, an outdoor sunscreen of the present invention has a reinforced margin which is formed by folding a tightly woven edge of a fabric sheet, fusion-welding inner surfaces of the folded edge together to form the reinforced margin and punching the reinforced margin for forming arcuate slits for tightening ropes. The edge of the fabric sheet of the sunscreen is more tightly woven than the inside section of the sheet, so that the opposed ends of the arcuate slits are prevented from more tearing irrespective of tensile forces applied thereto from their ropes. This makes the sunscreen long-lived. With the tightly woven reinforced margin, additional slit for additional tightening rope may be formed on the margin, so that this sunscreen can be pitched with balance even on an uneven ground. Since the sunscreen has no eyelet, it is simply produced with high productivity and reused or reproduced by a simple process.

Although the preferred embodiments of the present invention have been disclosed for illustrative purposes, those skilled in thee art will appreciate that various modifications, additions and substitutions are possible, without departing from the scope and of the invention as disclosed in the accompanying claims.

What is claimed is:

1. An outdoor sunscreen cover, comprising:

a fabric sheet having a reinforced margin;

said reinforced margin being a two-layered structure and lengthwise receiving a reinforcing band therein, said margin being formed by folding an edge of the sheet with said reinforcing band lengthwise placed in the folded edge and by fusion welding of inner surfaces of said folded edge together through a high frequency heating; and a plurality of arcuate punched slits provided on said reinforced margin, each said slit defining a rope reception hole, wherein wefts and warps of said reinforced margin are more tightly woven about each punched slit, relative to the wefts and warps of other portions of the fabric sheet, to thereby endure a tensile force applied thereto from a tightened rope.

2. The outdoor sunscreen cover of claim 1, wherein said reinforcing band extends between an edge of said reinforced margin and said arcuate punched slits.

3. The outdoor sunscreen cover of claim 1, wherein said reinforced band is immovably retained within said margin as a result of said fusion welding of said inner surfaces together.

4. The outdoor sunscreen cover of claim 1, wherein said reinforced band is immovably disposed within the reinforced margin in the width direction.

5. An outdoor sunscreen cover, comprising a fabric sheet having a reinforced margin, said reinforced margin being a two-layered structure and lengthwise receiving a reinforcing band therein, said margin being formed by folding an edge of said sheet onto itself with said reinforcing band placed inbetween said folded portion; and a plurality of arcuate punched slits formed in said reinforced margin at spaced intervals from each other to each define a rope or pole receiving hole, wherein said reinforcing band extends between an edge of said reinforced margin and said arcuate punched slits, wherein wefts and warps of said reinforced margin are more tightly woven about each punched slit, relative to the wefts and warps of other portions of the fabric sheet, to thereby endure a tensile force applied thereto from a tightened rope.

6. An outdoor sunscreen cover, comprising a fabric sheet having a reinforced margin formed by folding an edge of said sheet onto itself and by fusion welding inner surfaces of said folded portions to create a substantially continuous fusion weld extending continuously the length and width of said reinforced margin; and openings provided on said reinforced margin at spaced intervals from each other to define at least one of rope and pole receiving holes, wherein wefts and warps of said reinforced margin are more tightly woven about each punched slit, relative to the wefts and warps of other portions of the fabric sheet, to thereby endure a tensile force applied thereto from a tightened rope.

7. The outdoor sunscreen cover of claim 6, wherein said reinforcing band extends between an edge of said reinforced margin and said arcuate punched slits.

* * * * *